US010337081B2

(12) United States Patent
Reed, Jr. et al.

(10) Patent No.: US 10,337,081 B2
(45) Date of Patent: Jul. 2, 2019

(54) APPARATUS FOR ANNEALING ALLOY RIBBON AND METHOD OF PRODUCING ANNEALED ALLOY RIBBON

(71) Applicants: Metglas, Inc., Conway, SC (US); HITACHI METALS, LTD., Minato-ku, Tokyo (JP)

(72) Inventors: Donald Robert Reed, Jr., Conway, SC (US); Joseph Custis Boggs, Conway, SC (US); Norman Eugene Fuller, Jr., Conway, SC (US)

(73) Assignees: Metglas, Inc., Conway, SC (US); HITACHI METALS, LTD., Tokyo (JP)

( * ) Notice: Subject to any disclaimer, the term of this patent is extended or adjusted under 35 U.S.C. 154(b) by 253 days.

(21) Appl. No.: 15/343,219

(22) Filed: Nov. 4, 2016

(65) Prior Publication Data

US 2018/0127851 A1 May 10, 2018

(51) Int. Cl.
*C21D 9/56* (2006.01)
*C21D 9/573* (2006.01)

(52) U.S. Cl.
CPC ..... *C21D 9/56* (2013.01); *C21D 9/563* (2013.01); *C21D 9/564* (2013.01); *C21D 9/5735* (2013.01)

(58) Field of Classification Search
CPC ..... C21D 9/56; C21D 9/5735
See application file for complete search history.

(56) References Cited

U.S. PATENT DOCUMENTS

| | | | | |
|---|---|---|---|---|
| 1,747,145 | A * | 2/1930 | Schumacher | C21D 9/52 148/641 |
| 4,482,402 | A | 11/1984 | Taub | |
| 4,782,994 | A | 11/1988 | Raybould et al. | |
| 2003/0226618 | A1 | 12/2003 | Herzer et al. | |
| 2013/0139929 | A1 | 6/2013 | Francoeur et al. | |
| 2018/0127851 | A1 * | 5/2018 | Reed, Jr. | C21D 9/56 |

FOREIGN PATENT DOCUMENTS

JP H05-25551 A 2/1993

OTHER PUBLICATIONS

International Search Report issued in International Application No. PCT/JP2017/039604 dated Feb. 6, 2018.
Written Opinion of the ISA issued in International Application No. PCT/JP2017/039604 dated Feb. 6, 2018.

* cited by examiner

*Primary Examiner* — Scott R Kastler
(74) *Attorney, Agent, or Firm* — SOLARIS Intellectual Property Group, PLLC

(57) ABSTRACT

An apparatus for annealing alloy ribbon, the apparatus comprising: an unwinder unwinding an alloy ribbon from a spool of the alloy ribbon; a heating member comprising a first flat surface, on which the alloy ribbon unwound by the unwinder runs while contacting the first flat surface, the heating member heating the alloy ribbon running while contacting the first flat surface through the first flat surface; a cooling member comprising a second flat surface, on which the alloy ribbon heated by the heating member runs while contacting the second flat surface, the cooling member cooling the alloy ribbon running while contacting the second flat surface through the second flat surface; and a winder winding the alloy ribbon cooled by the cooling member.

6 Claims, 3 Drawing Sheets

APPARATUS FOR ANNEALING ALLOY RIBBON AND METHOD OF PRODUCING ANNEALED ALLOY RIBBON

BACKGROUND

Technical Field

The present disclosure relates to an apparatus for annealing alloy ribbon, and to a method of producing annealed alloy ribbon.

Related Art

Conventionally, technologies to anneal alloy ribbon have been known.

For example, Patent Literature 1 discloses an apparatus for in-line annealing of an amorphous strip which is an example of the alloy ribbon, the apparatus including: plural feeding rollers for feeding amorphous strips, a pair of hot-pressing rollers for superposing and rapidly annealing plural amorphous strips fed from the plural feeding rollers, thereby forming a composite strip, heating means for further heating the obtained composite strip, cooling means for cooling the heated composite strip (for example, compressed air jet), and a winding roller winding the cooled composite strip (see, for example, FIG. 1 in the same literature).

Patent Literature 2 discloses an apparatus and a method of annealing amorphous alloy ribbon by irradiating amorphous metal ribbon in the state of being wound around a core form with a laser beam or the like to heat the amorphous metal ribbon and by jetting an inert gas or the like to cool the amorphous metal ribbon (see, for example, FIG. 5 in the same literature).

Patent Literature 3 discloses a system for treating amorphous alloy ribbon, the system including: a mobile apparatus for feeding amorphous alloy ribbon forward along a running path at a set feed rate, tensioning the amorphous alloy ribbon, and guiding the amorphous alloy ribbon; a heating system (specifically, a hot roller) for heating the amorphous alloy ribbon to a temperature for starting heat treatment at a rate of more than $10^{3\circ}$ C./sec at a point along the running path; a first cooling system (specifically, a cold roller) for cooling the amorphous alloy ribbon at a rate of more than $10^{3\circ}$ C./sec until the heat treatment is ended; a mechanical constraint application apparatus for applying a series of mechanical constraints to the ribbon during the heat treatment until the amorphous alloy ribbon has a specific shape in a resting state after the heat treatment; and a second cooling system for cooling the amorphous alloy ribbon at a rate, at which the specific shape is kept, after the heat treatment (see, for example, claim 59 as well as FIG. 1, FIG. 6*a*, and FIG. 6*b* in this literature).

Patent Literature 1: U.S. Pat. No. 4,782,994

Patent Literature 2: U.S. Pat. No. 4,482,402

Patent Literature 3: U.S. Patent Application Publication No. 2013/0139929 A1.

SUMMARY OF THE INVENTION

Technical Problem

In the case of annealing alloy ribbon for the purpose of improving the magnetic properties of the alloy ribbon, the annealed alloy ribbon tends to embrittle (to become brittle) in comparison with the alloy ribbon before the annealing.

Accordingly, it is desirable to suppress embrittlement due to the annealing as much as possible.

However, it may be impossible to suppress embrittlement due to the annealing by the technologies described in Patent Literatures 1 (the details thereof will be described later).

Further, the technologies described in Patent Literatures 2 may make it impossible to sufficiently improve the magnetic properties of the alloy ribbon. (the details thereof will be described later).

Not a curved surface shaped alloy ribbon, but rather a flat surface shaped alloy ribbon may be demanded as an annealed alloy ribbon.

For example, flat surface shaped alloy ribbon may be demanded as annealed alloy ribbon for cutting out the flat surface shaped alloy ribbon pieces of a layered block core including plural layered blocks in which the flat surface shaped alloy ribbon pieces are layered.

Accordingly, a problem in one aspect of the present invention is to provide an apparatus for annealing alloy ribbon, capable of producing flat surface shaped alloy ribbon whose magnetic properties are improved by annealing, and in which embrittlement due to the annealing is suppressed.

A problem in another aspect of the invention is to provide a method of producing annealed alloy ribbon, capable of producing flat surface shaped alloy ribbon whose magnetic properties are improved by annealing, and in which embrittlement due to the annealing is suppressed.

Solution to Problem

Specific means for solving the problems include the following aspects.

<1> An apparatus for annealing alloy ribbon, the apparatus comprising:

an unwinder unwinding an alloy ribbon from a spool of the alloy ribbon, a heating member comprising a first flat surface on which the alloy ribbon unwound by the unwinder runs while contacting the first flat surface, the heating member heating the alloy ribbon running while contacting the first flat surface through the first flat surface, a cooling member comprising a second flat surface on which the alloy ribbon heated by the heating member runs while contacting the second flat surface, the cooling member cooling the alloy ribbon running while contacting the second flat surface through the second flat surface, a winder winding the alloy ribbon cooled by the cooling member.

<2> The apparatus for annealing alloy ribbon according to <1>, wherein the heating member is housed in a heating chamber.

<3> The apparatus for annealing alloy ribbon according to <1> or <2>, wherein a sucking structure sucking the alloy ribbon is provided at at least one of the first flat surface of the heating member or the second flat surface of the cooling member.

<4> The apparatus for annealing alloy ribbon according to <3>, wherein the sucking structure comprises an opening.

<5> The apparatus for annealing alloy ribbon according to <3> or <4>, wherein at least one of the heating member or the cooling member is divided into plural portions in an alloy ribbon running direction.

<6> The apparatus for annealing alloy ribbon according to any one of <1> to <5>, further comprising a tension adjuster adjusting tension of the alloy ribbon during heating by the heating member.

<7> The apparatus for annealing alloy ribbon according to any one of <1> to <6>, used for producing an alloy ribbon out of which flat surface shaped alloy ribbon pieces are cut, the flat surface shaped alloy ribbon pieces being layered to form a plurality of layered blocks comprised in a layered block core.

<8> A method of producing annealed alloy ribbon by using the apparatus for annealing alloy ribbon according to any one of <1> to <7>, the method comprising:

unwinding the alloy ribbon from the spool of the alloy ribbon by the unwinder, heating the alloy ribbon unwound by the unwinder by making the alloy ribbon run while making the alloy ribbon contact the first flat surface of the heating member, cooling the alloy ribbon heated by the heating member by making the alloy ribbon run while making the alloy ribbon contact the second flat surface of the cooling member, and winding the alloy ribbon cooled by the cooling member by the winder.

Advantageous Effects of Invention

According to one aspect of the invention, an apparatus for annealing alloy ribbon, capable of producing flat surface shaped alloy ribbon whose magnetic properties are improved by annealing, and in which embrittlement due to the annealing is suppressed.

According to another aspect of the invention, a method of producing annealed alloy ribbon, capable of producing flat surface shaped alloy ribbon whose magnetic properties are improved by annealing, and in which embrittlement due to the annealing is suppressed.

DETAILED DESCRIPTION OF THE INVENTION

Figure 1:
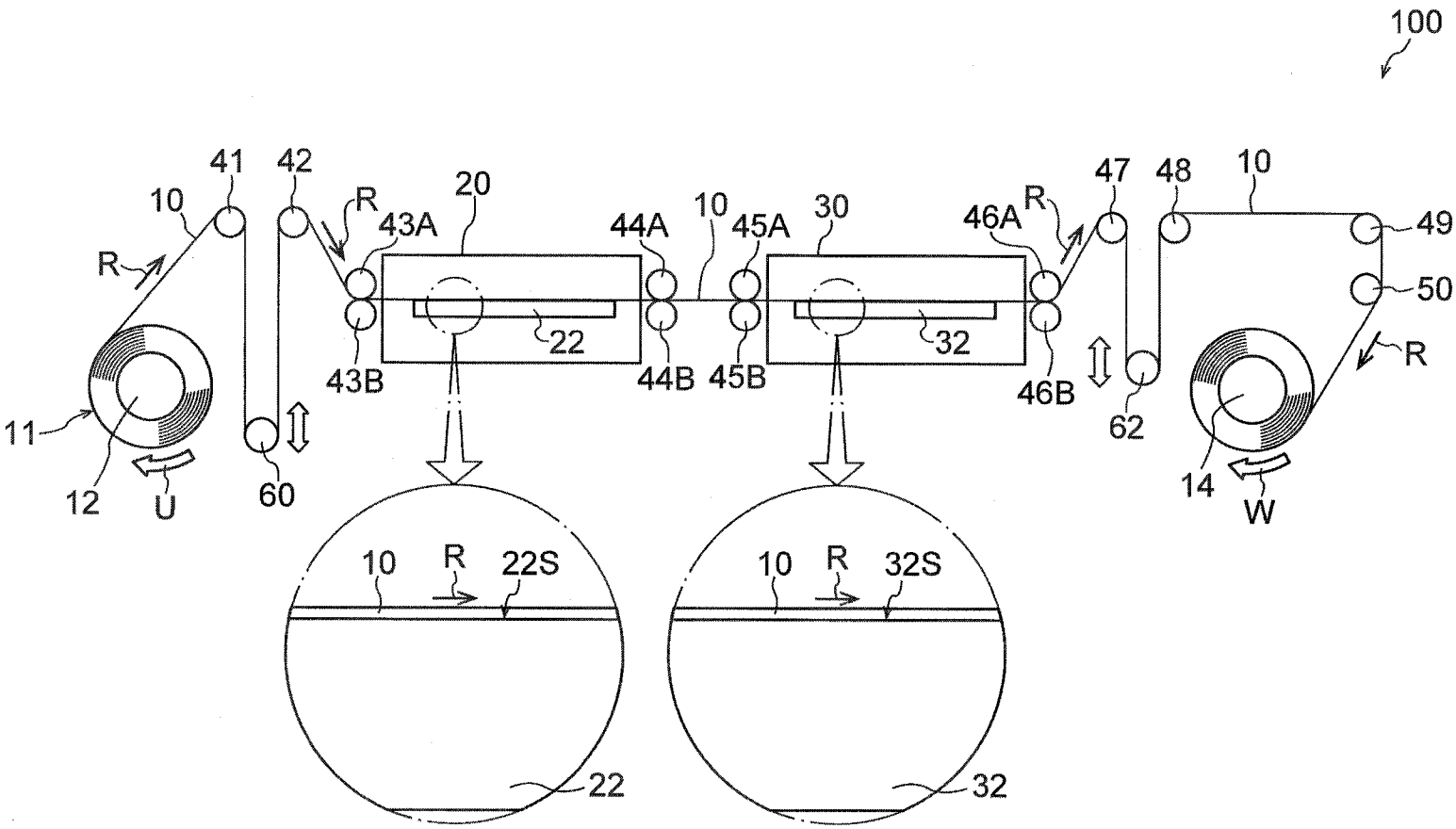
FIG. 1 is a schematic cross-sectional view illustrating an in-line annealing apparatus which is a specific example of one embodiment of the invention.

One embodiment of the invention (hereinafter also referred to as "the embodiment") will be described below.

A numerical range expressed by "x to y" herein includes the values of x and yin the range as the minimum and maximum values, respectively.

"Alloy ribbon piece" herein means a strip member cut out from alloy ribbon.

"Annealing" herein means heating and cooling (i.e., process from start of heating to end of cooling).

[Apparatus for Annealing Alloy Ribbon]

An apparatus for annealing alloy ribbon of the embodiment (hereinafter also referred to as "annealing apparatus of the embodiment") includes:

an unwinder unwinding an alloy ribbon from a spool of the alloy ribbon, a heating member including a first flat surface on which the alloy ribbon unwound by the unwinder runs while contacting the first flat surface, the heating member heating the alloy ribbon running while contacting the first flat surface through the first flat surface, a cooling member including a second flat surface on which the alloy ribbon heated by the heating member runs while contacting the second flat surface, the cooling member cooling the alloy ribbon running while contacting the second flat surface through the second flat surface, and a winder winding the alloy ribbon cooled by the cooling member.

According to the annealing apparatus of the embodiment, flat surface shaped alloy ribbon in which embrittlement due to annealing is suppressed and whose the magnetic properties are improved by the annealing can be produced.

In other words, the annealing apparatus of the embodiment enables the alloy ribbon to be annealed so that substantially no tendencies toward a curved surface shape remain. By the annealing apparatus of the embodiment, a flat surface shaped alloy ribbon whose magnetic properties are improved by the annealing can be produced, and moreover, embrittlement of the alloy ribbon due to the annealing can be suppressed.

The reason that the embodiment makes it possible to exhibit the effect of suppressing the embrittlement due to the annealing is presumed as follows.

The heating member in the embodiment includes the first flat surface on which the alloy ribbon runs while contacting the first flat surface, as described above.

The heating member heats the alloy ribbon running while contacting the first flat surface of the heating member through the first flat surface. As a result, stable rapid heating of the alloy ribbon is enabled.

The stable rapid heating can be considered to principally contribute to the effect of suppressing embrittlement due to the annealing. "Stable rapid heating" refers to rapid heating in which in-plane variations in heating rate are suppressed, and in which fluctuations in heating rate during continuous treatment are suppressed (the same applies hereinafter).

In contrast to the embodiment, the technology of heating alloy ribbon using a pair of hot-pressing rollers, described in Patent Literature 1, makes it difficult to constantly allow the hot-pressing rollers to come in close contact with the whole ribbon in the width direction thereof due to the influences of the heat deformation, partial wear, and the like of the pair of hot-pressing rollers, and may therefore make it difficult to heat the whole ribbon without any variations in the width direction thereof. Therefore, the alloy ribbon may embrittle due to annealing (primarily heating) in the technology described in Patent Literature 1.

In contrast to the embodiment, a technology of heating alloy ribbon by a non-contact heating method (for example, the technology of heating by irradiation with a laser beam or the like, described in Patent Literature 2) may make it impossible to sufficiently increase the temperature of the alloy ribbon.

For example, the technology of heating by irradiation with a laser beam or the like, described in Patent Literature 2, hardly makes it possible to ensure retention time at the maximum temperature, as shown in the temperature profile of FIG. 8 in this literature. Accordingly, the technology of annealing by heating alloy ribbon by the non-contact heating method may make it impossible to sufficiently improve the magnetic properties of the alloy ribbon.

The reason of obtaining the flat surface shaped alloy ribbon whose magnetic properties was improved by annealing in the embodiment is presumed as follows.

The cooling member in the embodiment includes the second flat surface on which the alloy ribbon runs while contacting the second flat surface, in a manner similar to that of the heating member. The cooling member cools the alloy ribbon running while contacting the second flat surface of the cooling member through the second flat surface.

In other words, in the annealing apparatus of the embodiment, the alloy ribbon is heated in the state of keeping the flat surface shape by contacting the first flat surface of the heating member, and is then cooled in the state of keeping the flat surface shape by contacting the second flat surface of the cooling member. It can be considered that heating and cooling in such an aspect enables alloy ribbon to be annealed so that substantially no tendencies toward a curved surface shape remain, and that a flat surface shaped alloy ribbon whose magnetic properties are improved by the annealing is obtained.

The alloy ribbon after having been cooled (i.e., after having been annealed) is wound by a winder. Due to the fact that the wound alloy ribbon is unwound and returned to the flat surface shape, it can be considered that a flat surface shaped alloy ribbon whose magnetic properties are improved by the annealing is obtained.

The annealing apparatus of the embodiment is suitable, for example, for producing alloy ribbon for cutting an alloy ribbon piece which is one member of a layered block core (i.e., a core including plural layered blocks in which flat surface shaped alloy ribbon pieces are layered).

In the case of producing the layered block core, a flat surface shaped alloy ribbon which is produced by the annealing apparatus of the embodiment, whose magnetic properties are improved by the annealing, and in which embrittlement due to the annealing is suppressed, is used as a raw material. The flat surface shaped alloy ribbon pieces whose magnetic properties are improved by the annealing can be easily produced with the alloy ribbon as the raw material. The layered block core can be produced without introducing a large strain by layering the obtained flat surface shaped alloy ribbon pieces. Therefore, a layered block core having excellent magnetic properties is obtained.

In other words, the layered block core of which deterioration of the magnetic properties is suppressed, and whose magnetic properties are excellent is obtained because it is not necessary to apply excessive stress during processing for producing the layered block core.

From the viewpoint of making it possible to more effectively obtain the effects of the embodiment, it is preferable that the heating member is housed in a heating chamber.

As a result, the alloy ribbon can be more stably rapidly heated, and therefore, the embrittlement of the alloy ribbon due to the annealing is further suppressed.

From the viewpoint of making it possible to more effectively obtain the effects of the embodiment, it is preferable that a sucking structure for sucking the alloy ribbon is provided at least one of the first flat surface of the heating member or the second flat surface of the cooling member.

From the viewpoint of making it possible to more effectively obtain the effects of the embodiment, it is more preferable that the sucking structure is provided at least the first flat surface of the heating member, and it is particularly preferable that the sucking structure is provided at both the first flat surface of the heating member and the second flat surface of the cooling member.

The sucking of the alloy ribbon by the sucking structure enables the alloy ribbon to more stably contact the first flat surface of the heating member and/or the second flat surface of the cooling member, and therefore enables the alloy ribbon to be more stably heated and/or cooled. Accordingly, the effects of the embodiment can be more effectively exhibited.

"Enable 'a' to more stably contact 'b'" refers to the possibility of allowing "a" to contact "b" while further suppressing generation of a non-contact portion in a surface and while further suppressing occurrence of a temporary non-contact state (the same applies hereinafter).

It is preferable that the sucking structure includes an opening.

The alloy ribbon can be allowed to more stably contact the first flat surface of the heating member and/or the second flat surface of the cooling member because the alloy ribbon can be sucked to the first flat surface of the heating member and/or the second flat surface of the cooling member by evacuating a space of which one end is the opening (for example, a through-hole).

The sucking structure is not limited to the opening provided at the first flat surface and/or the second flat surface, and may be, for example, a groove provided at a contact surface with the alloy ribbon in the first flat surface and/or the second flat surface. The alloy ribbon can also be allowed to more effectively contact the first flat surface and/or the second flat surface by evacuating the groove from a side direction (i.e., a direction parallel to the first flat surface and/or second flat surface, e.g., a direction parallel to the first flat surface and/or the second flat surface and orthogonal to an alloy ribbon running direction).

It is preferable that at least one of the heating member or the cooling member is divided into plural portions in an alloy ribbon running direction in a case in which the sucking structure is provided at least one of the first flat surface of the heating member or the second flat surface of the cooling member (preferably, at least the first flat surface of the heating member).

As a result, the alloy ribbon can be sucked into each of plural portions, and therefore, the alloy ribbon can be allowed to more stably contact the first flat surface of the heating member and/or the second flat surface of the cooling member.

It is preferable that the annealing apparatus of the embodiment further includes a tension adjuster adjusting the tension of the alloy ribbon during heating by the heating member (i.e., during running on the flat surface of the heating member).

As a result, the tension of the running alloy ribbon can be adjusted, and therefore, the alloy ribbon can be allowed to more stably run while suppressing the rupture of the alloy ribbon. As a result, the magnetic properties of the alloy ribbon can be improved.

In a case in which the sucking structure described above is provided at a surface of the heating member, the alloy ribbon can be allowed to more stably run by adjusting the tension of the alloy ribbon in consideration of the force of sucking.

The tension adjuster may be an apparatus for adjusting the tension of a portion, of the running alloy ribbon, from a running direction upstream side of the heating member to a running direction downstream side of the cooling member.

The annealing apparatus of the embodiment may include the single or plural tension adjusters.

The annealing apparatus of the embodiment may include a pressing structure pressing part or the whole of the alloy ribbon in the width direction thereof to at least one of the first flat surface of the heating member or the second flat surface of the cooling member, instead of or in addition to the sucking structure described above. The effects of the embodiment can also be more effectively exhibited in a case in which the annealing apparatus of the embodiment includes the pressing structure.

Examples of the pressing structure include a pressing structure including a pressing member such as a pressing roller, and a gas supply structure for supplying gas into a heating chamber and/or a cooling chamber, thereby pressing alloy ribbon by gasflow.

Specific Examples

Specific examples of the annealing apparatus of the embodiment will be described below with reference to the drawings.

In all the drawings, members having substantially the same functions may be denoted by the same reference numerals, whereby descriptions thereof may be omitted.

FIG. 1 is a schematic cross-sectional view illustrating an in-line annealing apparatus 100 which is a specific example of the annealing apparatus of the embodiment. FIG. 1 includes a partially enlarged view of a portion enclosed in a circle of a heating plate 22, and a partially enlarged view of a portion enclosed in a circle of a cooling plate 32.

As illustrated in FIG. 1, the in-line annealing apparatus 100 includes an unwinding roller 12 (unwinder) unwinding alloy ribbon 10 from a spool 11 of the alloy ribbon, the heating plate 22 (heating member) heating the alloy ribbon 10 unwound from the unwinding roller 12, the cooling plate 32 (cooling member) cooling the alloy ribbon 10 heated by the heating plate 22, and a winding roller 14 (winder) winding the alloy ribbon 10 cooled by the cooling plate 32.

In FIG. 1, the direction of running of the alloy ribbon 10 is denoted by an arrow R.

The spool 11 of the alloy ribbon is set in the unwinding roller 12.

The alloy ribbon 10 is unwound from the spool 11 of the alloy ribbon by axially rotating the unwinding roller 12 in the direction of an arrow U.

In this example, the unwinding roller 12 itself may include a rolling mechanism (for example, motor), or the unwinding roller 12 itself does not necessarily include a rolling mechanism.

Even in a case in which the unwinding roller 12 itself includes no rolling mechanism, the alloy ribbon 10 is unwound from the spool 11 of the alloy ribbon set in the unwinding roller 12 in conjunction with the operation of winding the alloy ribbon 10 by the winding roller 14 described later.

As illustrated in the expanded portion enclosed in the circle in FIG. 1, the heating plate 22 includes a first flat surface 22S on which the alloy ribbon 10 unwounded from the unwinding roller 12 runs while contacting the first flat surface 22S. The heating plate 22 heats the alloy ribbon 10 running on the first flat surface 22S while contacting the first flat surface 22S, through the first flat surface 22S. As a result, the running alloy ribbon 10 is stably rapidly heated.

The heating plate 22 is connected to a heat source which is not illustrated, and is heated to desired temperature by heat supplied from the heat source.

The heating plate 22 may include the heat source in the heating plate 22 itself, instead of being connected to the heat source.

Examples of the material of the heating plate 22 include stainless steel, Cu, Cu alloy, and Al alloy.

The heating plate 22 is housed in a heating chamber 20.

The heating chamber 20 may include heat sources for controlling the temperature of the heating chamber 20 in and/or around the heating chamber 20.

The heating chamber 20 includes an opening (not illustrated) at each of the upstream and downstream sides in a direction (arrow R) of the running of the alloy ribbon 10. The alloy ribbon 10 comes into the heating chamber 20 through the upstream opening, and exits from the heating chamber 20 through the downstream opening.

As illustrated in the expanded portion enclosed in the circle in FIG. 1, the cooling plate 32 includes a second flat surface 32S on which alloy ribbon 10 runs while contacting the second flat surface 32S. The cooling plate 32 cools the alloy ribbon 10 running on the second flat surface 32S while contacting the second flat surface 32S, through the second flat surface 32S.

The cooling plate 32 may include a cooling mechanism (for example, water-cooling mechanism), or does not necessarily include a particular cooling mechanism.

Examples of the material of the cooling plate 32 include stainless steel, Cu, Cu alloy, and Al alloy.

The cooling plate 32 is housed in a cooling chamber 30.

The cooling chamber 30 may include a cooling mechanism (for example, water-cooling mechanism), or does not necessarily include a particular cooling mechanism. In other words, an aspect of cooling by the cooling chamber 30 may be water-cooling or air-cooling.

The cooling chamber 30 includes an opening (not illustrated) in each of the upstream and downstream sides of the direction (arrow R) of the running of the alloy ribbon 10. The alloy ribbon 10 comes into the cooling chamber 30 through the upstream opening, and exits from the cooling chamber 30 through the downstream opening.

The winding roller 14 includes a rolling mechanism (for example, motor) that axially rotates in the direction of an arrow W. The alloy ribbon 10 is wound at a desired rate by the rotation of the winding roller 14.

The in-line annealing apparatus 100 includes a guide roller 41, a dancer roller 60 (tension adjuster), a guide roller 42, and a pair of guide rollers 43A and 43B along the pathway of running of the alloy ribbon 10 between the unwinding roller 12 and the heating chamber 20.

The dancer roller 60 is disposed movably in a vertical direction (direction of double-headed arrow in FIG. 1). The tension of the alloy ribbon 10 can be adjusted by adjusting the position of the dancer roller 60 in the vertical direction. The same also applies to a dancer roller 62.

The alloy ribbon 10 unwounded from the unwinding roller 12 is guided into the heating chamber 20 via the guide rollers and the dancer roller.

The in-line annealing apparatus 100 includes a pair of guide rollers 44A and 44B, and a pair of guide rollers 45A and 45B between the heating chamber 20 and the cooling chamber 30.

The alloy ribbon 10 having left the heating chamber 20 is guided into the cooling chamber 30 via the guide rollers.

The in-line annealing apparatus 100 includes a pair of guide rollers 46A and 46B, a guide roller 47, the dancer roller 62, a guide roller 48, a guide roller 49, and a guide roller 50 along the pathway of the running of the alloy ribbon 10 between the cooling chamber 30 and the winding roller 14.

The dancer roller 62 is disposed movably in a vertical direction (direction of double-headed arrow in FIG. 1). The tension of the alloy ribbon 10 can be adjusted by regulating the position of the dancer roller 62 in the vertical direction.

The alloy ribbon 10 having left the cooling chamber 30 is guided to the winding roller 14 via the guide rollers and the dancer roller.

In the in-line annealing apparatus 100, the guide rollers arranged at the upstream and downstream sides of the heating chamber 20 have the function of adjusting the position of the alloy ribbon 10 in order to allow the alloy ribbon 10 to contact the whole of the first flat surface 22S of the heating plate 22.

In the in-line annealing apparatus 100, the guide rollers arranged in the upstream and downstream sides of the cooling chamber 30 have the function of adjusting the position of the alloy ribbon 10 in order to allow the alloy ribbon 10 to contact the whole of the second flat surface of the cooling plate 32.

Figure 2:
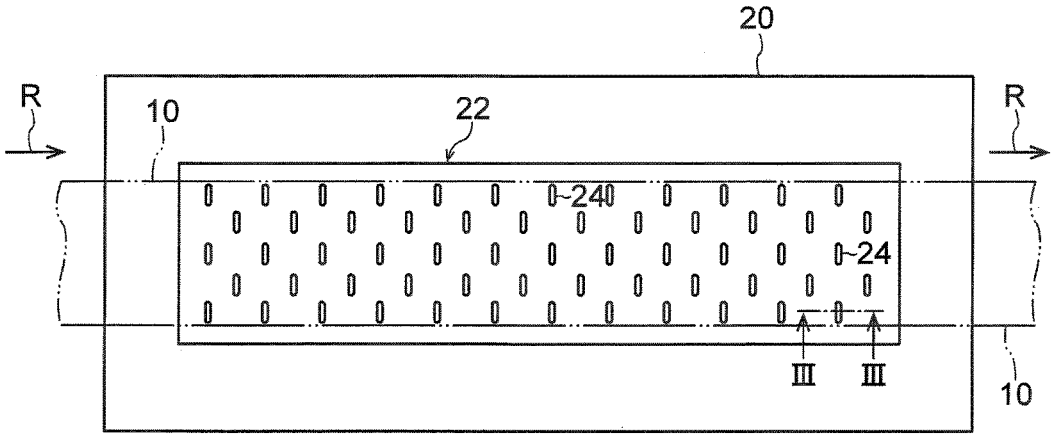
FIG. 2 is a schematic plan view illustrating the heating member of the in-line annealing apparatus illustrated in FIG. 1.
Figure 3:
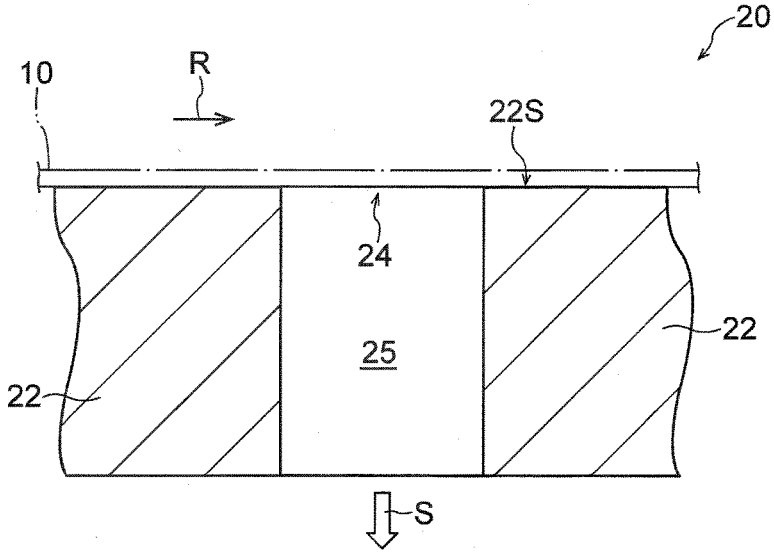
FIG. 3 is a view of a cross section taken along the line of FIG. 2.

FIG. 2 is a schematic plan view illustrating the heating plate 22 of the in-line annealing apparatus 100 illustrated in FIG. 1, and FIG. 3 is a view of a cross section taken along the line III-III of FIG. 2.

As illustrated in FIG. 2 and FIG. 3, plural openings 24 (sucking structure) are provided at the first flat surface of the heating plate 22 (i.e., contact surface with alloy ribbon 10). Each opening 24 configures one end of a through-hole 25 penetrating the heating plate 22.

In this example, the plural openings 24 are arranged in a two-dimensional form over the whole region coming in contact with the alloy ribbon 10.

The specific arrangement of the plural openings 24 is not limited to the arrangement illustrated in FIG. 2. It is preferable that the plural openings 24 are arranged in a two-dimensional form over the whole region coming in contact with the alloy ribbon 10, as illustrated in FIG. 2.

The shape of each opening 24 has an elongated shape having parallel portions (two parallel sides). The lengthwise direction of each opening 24 is a direction perpendicular to the running direction of the alloy ribbon 10.

The shape of each opening 24 is not limited to the shape illustrated in FIG. 2. Any shapes such as elongated shapes other than the shape illustrated in FIG. 2, oval shapes (including a circular shape), and polygonal shapes (for example, rectangular shapes), can be applied to the shape of each opening 24.

Instead of or in addition to the openings, a groove may also be disposed as a sucking structure, as described above.

In the in-line annealing apparatus 100, the internal space of the through-hole 25 is evacuated by a suction apparatus (for example, a vacuum pump) which is not illustrated (see arrow S), whereby the running alloy ribbon 10 can be sucked to the first flat surface 22S at which the openings 24 of the heating plate 22 are provided. As a result, the running alloy ribbon 10 can be allowed to more stably contact the first flat surface 22S of the heating plate 22.

In this example, the through-hole 25 penetrates from the first flat surface 22S to a flat surface opposite to the first flat surface 22S of the heating plate 22. The through-hole may penetrate from the first flat surface 22S to a side of the heating plate 22.

Figure 4:
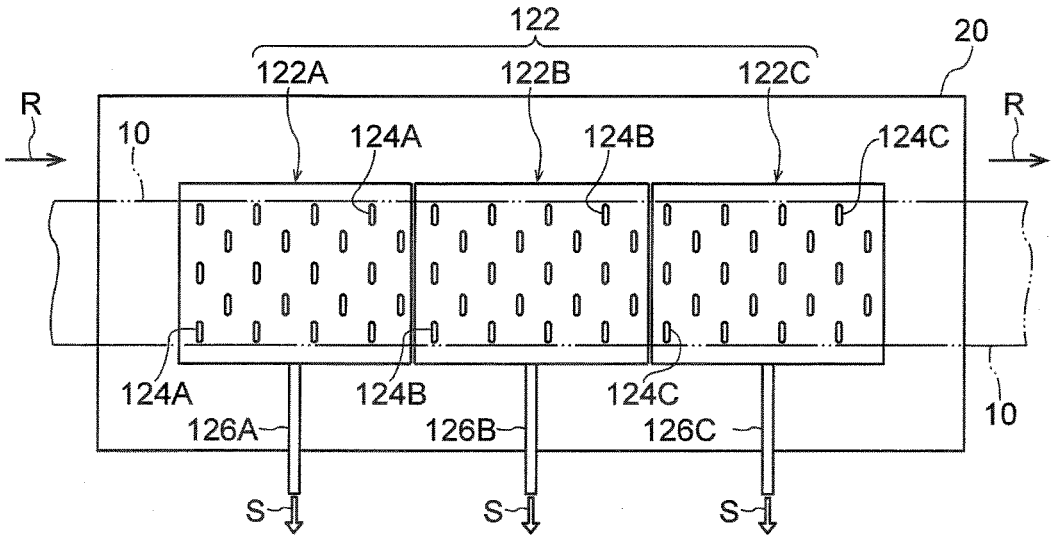
FIG. 4 is a schematic plan view illustrating a heating member in an alternative example of one embodiment of the invention.

FIG. 4 is a schematic plan view illustrating an alternative example (heating plate 122) of the heating plate in the embodiment.

In this alternative example, the heating plate 122 is divided into three portions (portions 122A to 122C) in the direction (arrow R) of running of the alloy ribbon 10, as illustrated in FIG. 4.

Plural openings 124A are provided at the portion 122A, plural openings 124B are provided at the portion 122B, and plural openings 124C are provided at the portion 122C. Each of the plural openings 124A, the plural openings 124B, and the plural openings 124C configures one end of a through-hole (not illustrated) similar to the through-hole 25.

In other words, each of the portions 122A to 122C has a sucking structure similar to the sucking structure in the heating plate 22. The through-holes of the portions 122A to 122C communicate with suction pipes 126A to 126C, respectively. The structures enable suction (evacuation) to be performed independently in each portion (see arrows S).

The heating plate 122 has the structures, whereby the alloy ribbon 10 can be sucked in each of the portions 122A to 122C. As a result, the running alloy ribbon 10 can be allowed to more stably contact the first flat surface 22S of the heating plate 22.

The number of portions into which the heating plate is divided is not limited to three, and can be set if appropriate in consideration of the length of the heating plate in an alloy ribbon running direction, or the like.

Referring back to FIG. 1 to FIG. 3, an example of the operation of annealing of the alloy ribbon 10 by the in-line annealing apparatus 100 will now be described.

First, the alloy ribbon 10 wound around the unwinding roller 12 is unwound by rotation of the unwinding roller 12.

The unwound alloy ribbon 10 comes into the heating chamber 20 sequentially via the guide roller 41, the dancer roller 60 (tension adjuster), the guide roller 42, and the pair of guide rollers 43A and 43B.

The alloy ribbon 10 having come into the heating chamber 20 runs on the first flat surface 22S while contacting the first flat surface 22S of the heating plate 22. As a result, the alloy ribbon 10 is rapidly heated through the first flat surface 22S. During the running of the alloy ribbon 10, the alloy ribbon 10 can be allowed to more stably contact the first flat surface 22S by evacuating the internal space of the through-hole 25 of the heating plate 22 by the suction apparatus (for example, vacuum pump) which is not illustrated (see arrow S).

The temperature of the first flat surface 22S of the heating plate 22 (i.e., heating temperature of alloy ribbon 10) is set at, for example, from 300° C. to 600° C.

Ambient temperature in the heating chamber 20 is set at temperature similar to the temperature of the first flat surface 22S of the heating plate 22.

The running speed of the alloy ribbon 10 running on the first flat surface 22S is set at, for example, from 0.05 m/s to 10 m/s (preferably from 0.1 m/s to 7.0 m/s, more preferably from 0.5 m/s to 5.0 m/s).

The running speed is adjusted by, for example, adjusting the rotational speed of the winding roller 14 (i.e., winding speed of alloy ribbon 10).

The tension of the heating alloy ribbon 10 may be adjusted by at least one of the dancer roller 60 or the dancer roller 62.

The tension of the alloy ribbon 10 that is being heated may be adjusted appropriately, depending on a purpose of the annealing. For example, the tension is adjusted to a range of from 1 MPa to 800 MPa.

The heating rate of the alloy ribbon 10 can also be adjusted by adjusting the relationships of the temperature of the first flat surface of the heating plate 22, the ambient temperature in the heating chamber 20, and the running speed of the alloy ribbon 10.

The heating rate of the alloy ribbon 10 is preferably adjusted to 200° C./s or more (more preferably 400° C./s or more, particularly preferably 500° C./s or more).

The alloy ribbon 10 heated by the heating plate 22 becomes apart from the first flat surface 22S of the heating plate 22, and then leaves the heating chamber 20.

The alloy ribbon 10 having left the heating chamber 20 comes into the cooling chamber 30 sequentially via the pair of guide rollers 44A and 44B, and the pair of guide rollers 45A and 45B.

The alloy ribbon 10 having come into the cooling chamber 30 runs on the second flat surface 32S while contacting the second flat surface 32S of the cooling plate 32. As a result, the alloy ribbon 10 is cooled through the second flat surface 32S.

The temperature of the second flat surface 32S of cooling plate 32 (i.e., cooling temperature of alloy ribbon 10) is, for example, 200° C. or less (preferably 150° C. or less, more preferably 100° C. or less). Ambient temperature in the cooling chamber 30 is, for example, temperature similar to the temperature of the flat surface of the cooling plate 32.

The running speed of the alloy ribbon 10 running on the second flat surface 32S of the cooling plate 32 is, for example, a running speed similar to the running speed of the alloy ribbon 10 running on the first flat surface 22S of the heating plate 22.

The tension of the alloy ribbon 10 that is being cooled is, for example, tension similar to the tension of the alloy ribbon 10 that is being heated.

The alloy ribbon 10 cooled by the cooling plate 32 becomes apart from the second flat surface 32S of the cooling plate 32, and then leaves the cooling chamber 30. The temperature of the alloy ribbon 10 immediately after leaving the cooling chamber 30 is, for example, 200° C. or less.

Then, the alloy ribbon 10 is wound by the winding roller 14 sequentially via the pair of guide rollers 46A and 46B, the guide roller 47, the dancer roller 62, the guide roller 48, the guide roller 49, and the guide roller 50.

The in-line annealing apparatus 100 and the alternative example thereof have been described above; however, the annealing apparatus of the embodiment is not limited to the in-line annealing apparatus 100 and the alternative example thereof.

For example, the flat surface 32S of the cooling plate 32 may also include an opening configuring one end of a through-hole similarly with the case of the flat surface 22S of the heating plate 22. The alloy ribbon 10 can be allowed to more stably contact the flat surface 32S by evacuation the internal space of the through-hole.

Further, in this case, the cooling plate 32 may be divided into plural portions in the direction of running of the alloy ribbon, similarly with the case of the heating plate 122.

The heating chamber 20 may also include a gas supply port for pressing the alloy ribbon 10 to the first flat surface 22S by gasflow, as the pressing structure described above. Examples of gas for the gasflow include air, $N_2$, and $CO_2$.

The alloy ribbon 10 can be allowed to more stably contact the first flat surface 22S by pressing the alloy ribbon 10 to the first flat surface 22S by gasflow.

The heating chamber 20 may also include a pressing member (for example, pressing roller) for pressing part or the whole of the alloy ribbon 10 in the width direction thereof to the first flat surface 22S, as the pressing structure described above. The alloy ribbon 10 can be allowed to more stably contact the first flat surface 22S by the pressing by the pressing member.

The cooling chamber 30 may similarly include a gas supply port and/or a pressing member.

The shape of the heating member in the embodiment preferably includes the first flat surface on which the alloy ribbon runs while contacting the first flat surface, and is not limited to a plate shape such as the shape of the heating plate 22.

The shape of the cooling member in the embodiment preferably includes the second flat surface on which the alloy ribbon runs while contacting the second flat surface, and is not limited to a plate shape such as the shape of the cooling plate 32.

The length of the first flat surface of the heating member (for example, the first flat surface 22S of the heating plate 22) in the alloy ribbon running direction is preferably 0.3 m or more, more preferably 0.5 m or more, and particularly preferably 1.0 m or more.

The length of the first flat surface of the heating member in the alloy ribbon running direction is preferably 10 m or less, more preferably 3.0 m or less, and particularly preferably 2.0 m or less.

The length of the second flat surface of the cooling member (for example, the second flat surface 32S of the cooling plate 32) in the alloy ribbon running direction is preferably 0.3 m or more, more preferably 0.5 m or more, and particularly preferably 1.0 m or more.

The length of the second flat surface of the cooling member in the alloy ribbon running direction is preferably 10 m or less, more preferably 3.0 m or less, and particularly preferably 2.0 m or less.

Alloy ribbon (for example, the alloy ribbon 10 in the spool 11) to be annealed by the annealing apparatus of the embodiment (for example, the in-line annealing apparatus 100) is not particularly limited, and amorphous alloy ribbon is preferable as the alloy ribbon.

For the amorphous alloy ribbon, reference to the descriptions of International Publication No. WO 2013/137117, International Publication No. WO 2013/137118, International Publication No. WO 2016/084741, and the like can be made if appropriate.

Of such amorphous alloy ribbons, Fe-based amorphous alloy ribbon is preferable.

As the Fe-based amorphous alloy ribbon, Fe-based amorphous alloy ribbon which contains Fe, Si, and B, and in which the content of Fe is 50 atomic % or more (preferably 60 atomic % or more, more preferably 70 atomic % or more) assuming that the total content of Fe, Si, and B is 100 atomic % is particularly preferable.

The width of the alloy ribbon is preferably 50 mm or more, and more preferably 100 mm or more.

The width of the alloy ribbon is preferably 500 mm or less, and more preferably 300 mm or less.

The thickness of the alloy ribbon is preferably 10 μm or more, and more preferably 15 μm or more.

The thickness of the alloy ribbon is preferably 30 μm or less.

The length of the alloy ribbon is preferably 10 m or more, more preferably 100 m or more, still more preferably 1000 m or more, and particularly preferably 3000 m or more.

The length of the alloy ribbon is preferably 40 km or less.

In a case in which the alloy ribbon to be annealed by the annealing apparatus of the embodiment is the Fe-based amorphous alloy ribbon, the annealing (i.e., the heating and the cooling) by the annealing apparatus of the embodiment may be an annealing by which an amorphous structure of the Fe-based amorphous alloy ribbon is not crystallized, and may be an annealing by which at least one portion of an amorphous structure of the Fe-based amorphous alloy ribbon is nano-crystallized.

In a case in which the alloy ribbon to be annealed by the annealing apparatus of the embodiment is the Fe-based amorphous alloy ribbon, a concept of "annealed alloy ribbon" includes both of a ribbon in which an amorphous structure of the Fe-based amorphous alloy ribbon is not crystallized (i.e., Fe-based amorphous alloy ribbon) and a ribbon in which at least one portion of an amorphous structure of the Fe-based amorphous alloy ribbon is nano-crystallized (i.e., Fe-based nano-crystal alloy ribbon).

For a composition of the Fe-based nano-crystal alloy ribbon, reference to the descriptions of International Publication No. WO 2015/046150 can be made if appropriate. As the composition of the Fe-based nano-crystal alloy ribbon, a composition represented by formula $(Fe_{1-a}M_a)_{100-x-y-z-\alpha-\beta-\gamma}Cu_xSi_yB_zM'_\alpha M''_\beta X_\gamma$ (wherein, M is Co and/or Ni; M' is at least one element selected from the group consisting of Nb, Mo, Ta, Ti, Zr, Hf, V, Cr, Mn and W; M" is at least one element selected from the group consisting of Al, platinum group elements, Sc, rare earth elements, Zn, Sn and Re; X is at least one element selected from the group consisting of C, Ge, P, Ga, Sb, In, Be and As; each of a, x, y, z, α, β and γ is an atomic %, and a, x, y, z, α, β and γ respectively satisfy $0 \le a \le 0.5$, $0.1 \le x \le 3$, $0 \le y \le 30$, $0 \le z \le 25$, $5 \le y+z \le 30$, $0 \le \alpha \le 20$, $0 \le \beta \le 20$ and $0 \le \gamma \le 20$) is preferable. In the composition represented by the formula $(Fe_{1-a}M_a)_{100-x-y-z-\alpha-\beta-\gamma}Cu_xSi_yB_zM'_\alpha M''_\beta X_\gamma$, a composition consisting of Fe, Cu, Si, B and Nb is particularly preferable.

In the annealing by which an amorphous structure of the Fe-based amorphous alloy ribbon is not crystallized, the temperature of the first flat surface 22S of the heating plate 22 (i.e., heating temperature of alloy ribbon 10) is set at preferably from 350° C. to 600° C., and more preferably from 400° C. to 550° C.

In the annealing by which an amorphous structure of the Fe-based amorphous alloy ribbon is not crystallized, the tension of the alloy ribbon 10 that is being heated is preferably adjusted to a range of from 1 MPa to 100 MPa.

In the annealing by which at least one portion of an amorphous structure of the Fe-based amorphous alloy ribbon is nano-crystallized, the temperature of the first flat surface 22S of the heating plate 22 (i.e., heating temperature of alloy ribbon 10) is set at preferably from 550° C. to 650° C.

In the annealing by which at least one portion of an amorphous structure of the Fe-based amorphous alloy ribbon is nano-crystallized, the tension of the alloy ribbon 10 that is being heated is preferably adjusted to a range of from 50 MPa to 800 MPa.

[Method of Producing Annealed Alloy Ribbon]

A method of producing annealed alloy ribbon of the embodiment (hereinafter also referred to as "production method of the embodiment") by using the annealing apparatus of the embodiment described above includes:

unwinding the alloy ribbon from the spool of the alloy ribbon by the unwinder, heating the alloy ribbon unwound by the unwinder by making the alloy ribbon run while making the alloy ribbon contact the first flat surface of the heating member, cooling the alloy ribbon heated by the heating member by making the alloy ribbon run while making the alloy ribbon contact the second flat surface of the cooling member, and winding the alloy ribbon cooled by the cooling member by the winder.

In other words, the production method of the embodiment is a method of annealing alloy ribbon.

According to the production method of the embodiment, flat surface shaped alloy ribbon whose magnetic properties are improved by annealing, and of which embrittlement due to the annealing is suppressed can be produced.

The above-described example of the annealing of the alloy ribbon 10 by the in-line annealing apparatus 100 can be referred as a specific example of the production method of the embodiment.

What is claimed is:

1. An apparatus for annealing alloy ribbon, the apparatus comprising:

an unwinder unwinding an alloy ribbon from a spool of the alloy ribbon;

a heating member comprising a first flat surface, on which the alloy ribbon unwound by the unwinder runs while contacting the first flat surface, the heating member heating the alloy ribbon running while contacting the first flat surface through the first flat surface;

a cooling member comprising a second flat surface, on which the alloy ribbon heated by the heating member runs while contacting the second flat surface, the cooling member cooling the alloy ribbon running while contacting the second flat surface through the second flat surface; and a winder winding the alloy ribbon cooled by the cooling member;

wherein a sucking structure sucking the alloy ribbon is provided at at least one of the first flat surface of the heating member or the second flat surface of the cooling member.

2. The apparatus for annealing alloy ribbon according to claim 1, wherein the heating member is housed in a heating chamber.

3. The apparatus for annealing alloy ribbon according to claim 1, wherein the sucking structure comprises an opening.

4. The apparatus for annealing alloy ribbon according to claim 1, wherein at least one of the heating member or the cooling member is divided into plural portions in an alloy ribbon running direction.

5. The apparatus for annealing alloy ribbon according to claim 3, wherein at least one of the heating member or the cooling member is divided into plural portions in an alloy ribbon running direction.

6. The apparatus for annealing alloy ribbon according to claim 1, further comprising a tension adjuster adjusting tension of the alloy ribbon during heating by the heating member.

* * * * *